US009939830B1

(12) United States Patent
Lee et al.

(10) Patent No.: US 9,939,830 B1
(45) Date of Patent: Apr. 10, 2018

(54) MULTIPLE VOLTAGE REGULATORS WITH INPUT VOLTAGE SENSING AND SLEEP MODE

(71) Applicant: DYNA IMAGE CORP., New Taipei (TW)

(72) Inventors: Sheng-Cheng Lee, New Taipei (TW); Wen-Sheng Lin, New Taipei (TW)

(73) Assignee: DYNA IMAGE CORP. (TW)

( * ) Notice: Subject to any disclaimer, the term of this patent is extended or adjusted under 35 U.S.C. 154(b) by 0 days.

(21) Appl. No.: 15/671,246

(22) Filed: Aug. 8, 2017

(30) Foreign Application Priority Data

May 22, 2017 (CN) ..... 2017 1 0364495

(51) Int. Cl.

| | |
|---|---|
| ***G05F 1/56*** | (2006.01) |
| ***G05F 1/563*** | (2006.01) |
| ***G05F 1/565*** | (2006.01) |
| ***G05F 1/575*** | (2006.01) |

(52) U.S. Cl.
CPC ..... *G05F 1/563* (2013.01); *G05F 1/565* (2013.01); *G05F 1/575* (2013.01)

(58) Field of Classification Search
CPC ..... G05F 1/56–1/62
See application file for complete search history.

(56) References Cited

U.S. PATENT DOCUMENTS

| | | | | |
|---|---|---|---|---|
| 9,058,049 | B2 * | 6/2015 | Pons | G05F 1/565 |
| 9,606,558 | B2 * | 3/2017 | Zolnhofer | G05F 1/575 |
| 2013/0135245 | A1 * | 5/2013 | Rai | G06F 1/3262 345/174 |
| 2013/0169246 | A1 * | 7/2013 | Shao | G05F 1/56 323/266 |
| 2013/0265060 | A1 * | 10/2013 | Orendi | G01R 31/40 324/537 |
| 2014/0070876 | A1 * | 3/2014 | Paillet | G06F 1/26 327/538 |

* cited by examiner

*Primary Examiner* — Gary L Laxton
*Assistant Examiner* — Peter Novak

(57) ABSTRACT

Differing from conventional LDO voltage regulator being unable to work at a sleep mode for saving power dissipation, the present invention discloses a smart low dropout (LDO) voltage regulator capable of being switched to an operation mode or a sleep mode based on the controlling of an enablable signal. This smart LDO voltage regulator comprises an input voltage detecting unit, a switch controlling unit and a voltage regulating module. During the sleep mode of the smart LDO voltage regulator, the switch controlling unit generates a switch controlling signal to change a switch setting of a switch unit of the voltage regulating module, so as to facilitate the smart LDO voltage regulator produce an output voltage through a first voltage regulating unit or a second voltage regulating unit of the voltage regulating module, or directly output input voltage as the output voltage.

20 Claims, 10 Drawing Sheets

MULTIPLE VOLTAGE REGULATORS WITH INPUT VOLTAGE SENSING AND SLEEP MODE

BACKGROUND OF THE INVENTION

1. Field of the Invention

The present invention relates to the technology field of electronic circuits, and more particularly to a smart low dropout voltage regulator and a smart voltage regulating method.

2. Description of the Prior Art

Along with the continuous advance of electronic sciences and technologies, there are many demands made by end-users for portable electronic devices, such as small size, thin profile and light weight. Therefore, a thin-profile battery is developed for integrated into the portable electronic device with small size and thin profile. Moreover, since the power capacity of the thin-profile battery is limited, power management ICs must be simultaneously arranged in the portable electronic device for extending standby time and managing the use of battery power. As a result, low dropout (LDO) voltage regulator, including a variety of advantages such as simple circuit framework and low noise, is developed and then widely applied in various power management ICs for assisting the power management ICs to provide a "clean" power to at least one load devices or back-end circuit units, like analog circuitry or RF circuitry.

FIG. 1 shows a circuit diagram of a conventional LDO voltage regulator, comprising: an error amplifier OP', a power MOSFET Q1', a first resistor R1', a second resistor R2', and an output capacitor Co'. During the operation of the LDO voltage regulator 1', the power MOSFET Q1' is configured to produce an output voltage $V_{out}'$ to a load unit 2' according to the variation of an input voltage $V_{in}'$. Moreover, from FIG. 1, electronic engineers should know that the error amplifier OP' is controlled by an enable signal $V_{En}'$ so as to produce an error signal $V_{er}'$ to the power MOSFET Q1' after receiving the output voltage $V_{out}'$ and a reference voltage $V_{REF}'$. Therefore, the power MOSFET Q1' is controlled by the error signal $V_{er}'$ and then provides the output voltage $V_{out}'$ to the load unit 2' stably.

It is worth explaining that, the power dissipation of the conventional LDO voltage regulator 1' shown in FIG. 1 can be calculated by using following mathematic formula (1).

$$PD=I_{out}'(KV_{in}'-V_{out}') \quad (1)$$

In the mathematic formula (1), PD means the power dissipation of the LDO voltage regulator 1', $I_{out}'$ represents an output current, and K is an adjusting factor approximating 1. Thus, from the mathematic formula (1), electronic engineers are able to understand that, some solutions must be developed to lower the power consumption caused by the LDO voltage regulator 1' when the load unit 2' (such as analog circuitry) enters a standby mode; otherwise, the battery power of a mobile electronic device integrated with the LDO voltage regulator 1' would still be constantly used. For above reasons, the inventors of the present application have made great efforts to make inventive research thereon and eventually provided a smart low dropout voltage regulator and a smart voltage regulating method.

SUMMARY OF THE INVENTION

The primary objective of the present invention is to provide a smart low dropout voltage regulator and a smart voltage regulating method. Differing from conventional LDO voltage regulator being unable to work at a sleep mode for saving power dissipation, the novel smart low dropout (LDO) voltage regulator of the present invention is capable of being switched to an operation mode or a sleep mode based on the controlling of an enablable signal. Moreover, this smart LDO voltage regulator comprises an input voltage detecting unit, a switch controlling unit and a voltage regulating module. During the sleep mode of the smart LDO voltage regulator, the switch controlling unit is configured to generates a switch controlling signal for changing a switch setting of a switch unit integrated in the voltage regulating module, so as to facilitate the smart LDO voltage regulator produce an output voltage through a first voltage regulating unit or a second voltage regulating unit particularly arranged in voltage regulating module, or directly output input voltage as the output voltage.

In order to achieve the primary objective of the present invention, the inventor of the present invention provides an embodiment for the smart low dropout voltage regulator, comprising:

an input voltage detecting unit, being coupled to an external power supply unit, used for sensing an input voltage provided by the power supply unit;

a switch controlling unit, being coupled to the input voltage detecting unit and an enable signal, using for correspondingly produce at least one switch controlling signal based on the enable signal and at least one input voltage sensing signal received from the input voltage detecting unit; and a voltage regulating module, being coupled to the switch controlling unit, the enable signal and the input voltage, and comprising:

- a low dropout (LDO) voltage regulating unit, being coupled to the input voltage and the enable signal;
- a first voltage regulating unit, being coupled to the input voltage;
- a second voltage regulating unit, being coupled to the input voltage; and a switch unit, being coupled between the LDO voltage regulating unit, the first voltage regulating unit and the second voltage regulating unit; moreover, the switch unit being also coupled to the switch controlling unit;

wherein the voltage regulating module is switched to an operation mode or a sleep mode by setting the enable signal to be a high-level signal or low-level signal;

wherein during the sleep mode, the switch controlling unit producing the said switch controlling signal to change a switch setting of the switch unit, so as to facilitate the smart low dropout voltage regulator generate an output voltage through the first voltage regulating unit or the second voltage regulating unit of the voltage regulating module.

Moreover, for achieving the primary objective of the present invention, the inventor of the present invention further provides an embodiment for the smart voltage regulating method, which comprises following steps:

(1) providing a smart low dropout voltage regulator comprising an input voltage detecting unit, a switch controlling unit and a voltage regulating module between a power supply unit and at least one load, wherein the voltage regulating module comprises a low dropout (LDO) voltage regulating unit, a first voltage regulating unit, a second voltage regulating unit, and a switch unit;

(2) setting an enable signal to be one high-level signal, and then inputting the enable signal to the switch unit and the LDO voltage regulating unit for making the smart low dropout voltage regulator work at an operation mode;

(3) setting a detection enabling signal to one high-level signal, and then inputting the detection enabling signal to the input voltage detecting unit, such that the input voltage detecting unit is configured to sensing an input voltage provided by the power supply unit;

(4) determining whether the enable signal is set to be one low-level signal, if yes, proceeding to step (5); otherwise, proceeding back to step (3);

(5) the switch controlling unit generating at least one switch controlling signal based on the enable signal and at least one input voltage sensing signal received from the input voltage detecting unit, and then the switch controlling signal is used to change a switch setting of the switch unit, so as to facilitate the smart low dropout voltage regulator produce an output voltage through the first voltage regulating unit or the second voltage regulating unit of the voltage regulating module, or directly output the input voltage as the output voltage;

(6) determining whether the enable signal is set to be the low-level signal, if yes, proceeding back to step (5); otherwise, proceeding back to step (3).

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a smart low dropout voltage regulator and a smart voltage regulating method according to the present invention, embodiments of the present invention will be described in detail with reference to the attached drawings hereinafter.

Figure 2:
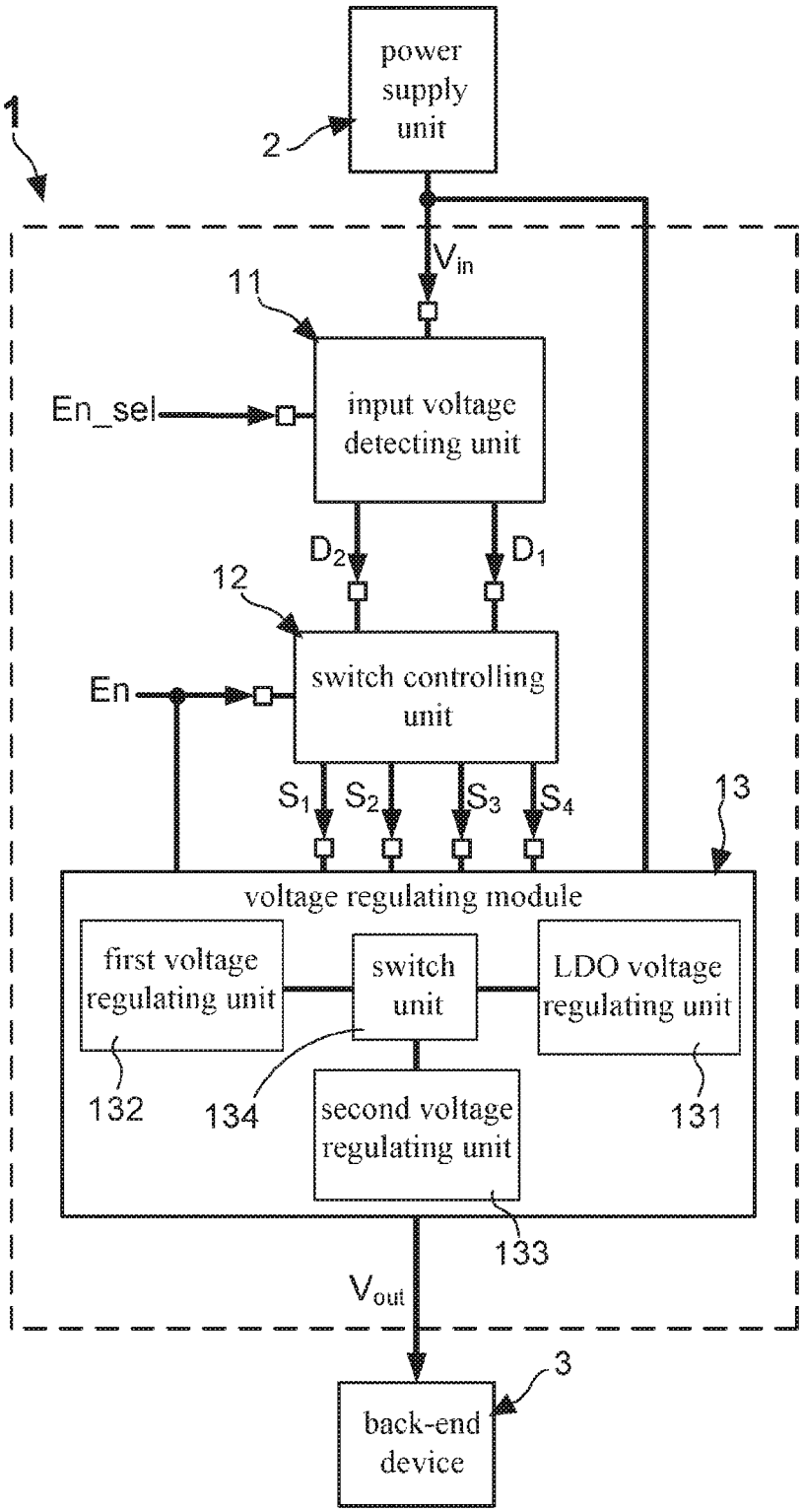
FIG. 2 shows a circuit block diagram of a smart low dropout voltage regulator according to the present invention.

With reference to FIG. 2, there is provided a circuit block diagram of a smart low dropout voltage regulator according to the present invention. The smart low dropout (LDO) voltage regulator 1 of the present invention is used for receiving an input voltage $V_{in}$ provided by a power supply unit 2, so as to output a clean and stable output voltage to a back-end device 3 such as analog circuitry or RF circuitry. As FIG. 2 shows, the smart LDO voltage regulator 1 comprises an input voltage detecting unit 11, a switch controlling unit 12 and a voltage regulating module 13. According to FIG. 2 and a circuit diagram of the input voltage detecting unit 11 shown in FIG. 3, engineers skilled in development and manufacture of electronic circuits are able to know that, the said input voltage detecting unit 11 is coupled to the power supply unit 2 for sensing the input voltage $V_{in}$ so as to correspondingly output at least one voltage sensing signal to the switch controlling unit 12. In the present invention, the said voltage sensing signal comprises a first sensing data signal $D_1$ and a second sensing data signal $D_2$.

Figure 3:
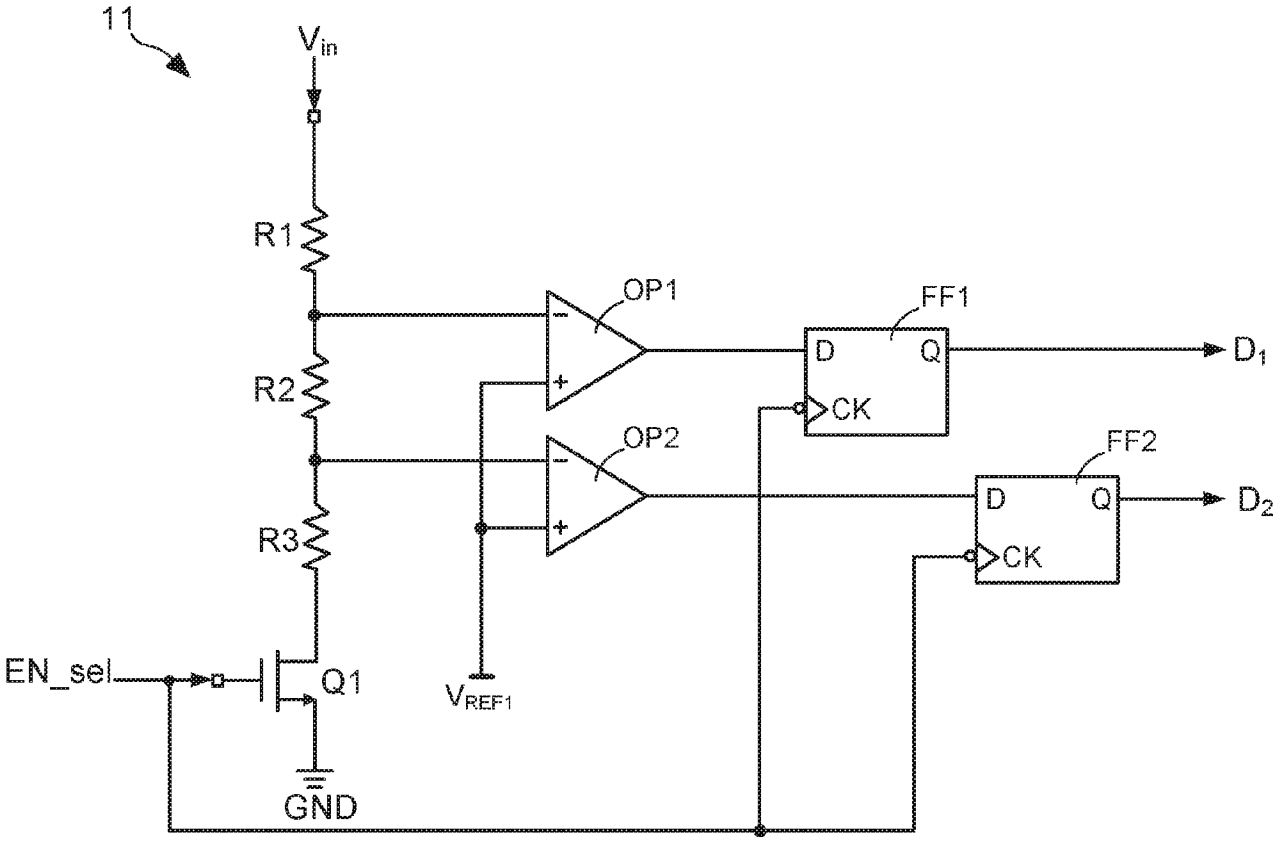
FIG. 3 shows a circuit diagram of an input voltage detecting unit.

As FIG. 2 and FIG. 3 show, the input voltage detecting unit 11 comprises: a first resistor R1, a first comparator OP1, a second resistor R2, a second comparator OP2, a third resistor R3, a first MOSFET Q1, a first flip-flop FF1, and a second flip-flop FF2. In which, the first resistor R1, the second resistor R2 and the third resistor R3 are serially connected, and the drain terminal of the first MOSFET Q1 is coupled to the third resistor R3. Herein the first MOSFET Q1 is an N-type MOSFET and taken as an activation element of the input voltage detecting unit 11, so that the gate terminal of the first MOSFET Q1 is coupled to a detection enabling signal En_sel. Moreover, the source terminal of the first MOSFET Q1 is coupled to a ground terminal GND.

Inheriting to above descriptions, the negative input end of the first comparator OP1 is connected between the first resistor R1 and the second resistor R2, and the negative input end of the second comparator OP2 is connected between the second resistor R2 and the third resistor R3. Moreover, the positive input end of the first comparator OP1 is coupled to a first reference voltage $V_{REF1}$, and the negative input end of the second comparator OP2 is coupled to a second reference voltage $V_{REF2}$. On the other hand, the a first flip-flop FF1 has two input ends and one output end, wherein the two input ends of the first flip-flop FF1 are coupled to the output end of the first comparator OP1 and the detection enabling signal En_sel, respectively. Similarly, the second flip-flop FF2 also has two input ends and one output end, wherein the two input ends of the second flip-flop FF2 are coupled to the output end of the second comparator OP2 and the detection enabling signal En_sel, respectively.

In the present invention, the switch controlling unit 12 is a combinatorial logic circuit with three input terminals and four output terminals, and configured for producing at least one switch controlling signal base on the first sensing data signal $D_1$, the second sensing data signal $D_2$, and an enable signal En. As FIG. 2 shows, the said switch controlling signal comprises a first switching signal $S_1$, a second switching signal $S_2$, a third switching signal $S_3$, and a fourth switching signal $S_4$. Moreover, it needs to be emphasized that the said combinatorial logic circuit with three input terminals and four output terminals can be developed by electronic engineers according to following basic logic circuit design rules:

(1) confirming fundamental requirements of a target logic circuit, for example, how many input ends and output ends;

(2) deriving a truth able for expressing relationships between input variables and output variables (3) constructing a Karnaugh maps for simplifying Boolean expressions of logic functions from the truth table;

(4) drawing the target logic circuit by combining and/or connecting a variety of basic logic gates according to the Boolean expressions of logic functions; and (5) verifying the obtained target logic circuit by simulation testing.

Since the said combinatorial logic circuit with three input terminals and four output terminals (i.e., the switch controlling unit 12 shown in FIG. 2) can be developed by electronic engineers according to above-listed basic logic circuit design rules, the present invention does not particularly limit the internal circuit constitution of the switch controlling unit 12. Continuously refer to FIG. 2, and please simultaneously refer to FIG. 4, which illustrates a circuit diagram of the voltage regulating module 13. According to FIG. 2 and FIG. 4, it is able to know that the voltage regulating module 13 is coupled to the switch controlling unit 12, the enable signal En and the input voltage $V_{in}$, and comprises a low dropout (LDO) voltage regulating unit 131, a first voltage regulating unit 132, a second voltage regulating unit 133, and a switch unit 134.

Inheriting to above descriptions, the LDO voltage regulating unit 131 is coupled to the input voltage $V_{in}$ and the enable signal En, and both the first voltage regulating unit 132 and the second voltage regulating unit 133 are also coupled to the input voltage $V_{in}$. It is worth explaining that, according to the circuit design of the present invention, the switch unit 134 is connected between the LDO voltage regulating unit 131, the first voltage regulating unit 132 and the second voltage regulating unit 133. Moreover, the switch unit 134 is also coupled to the switch controlling unit 12 for receiving the switch controlling signal ($S_1$, $S_2$, $S_3$, $S_4$).

Figure 4:
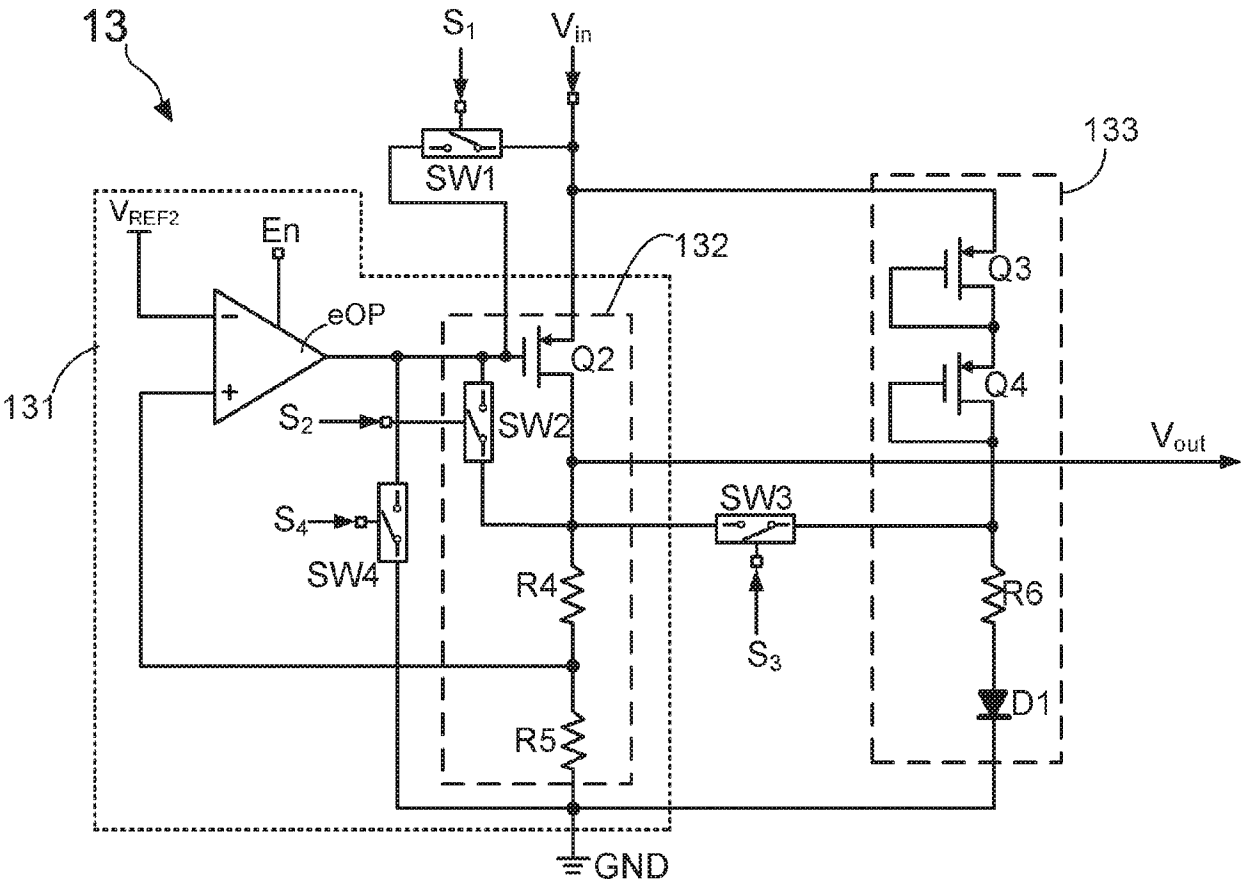
FIG. 4 shows a circuit diagram of a voltage regulating module.

As FIG. 4 shows, the LDO voltage regulating unit comprises a second MOSFET Q2, a fourth resistor R4, a fifth resistor R5, and an error amplifier eOP, wherein the source terminal of the second MOSFET Q2 is coupled to the input voltage $V_{in}$. It is noted that the switch unit 12 comprises a first switch SW1, a second switch SW2, a third switch SW3, and a fourth switch SW4, wherein the first switch SW1 is coupled between the source terminal and the gate terminal of the second MOSFET Q2, and the second switch SW2 is coupled between the gate terminal and the drain terminal of the second MOSFET Q2. On the other hand, the fourth resistor R4 is coupled to one drain terminal of the second MOSFET Q2 by one end thereof, and the fifth resistor R5 is coupled to the other end of the fourth resistor R4 by one end thereof. Moreover, the other end of the fifth resistor R5 is coupled to the ground terminal GND. Furthermore, the error amplifier eOP is coupled to a second reference voltage $V_{REF2}$ and the gate terminal of the second MOSFET Q2 by the negative input end and the output end thereof, and the positive input end of the error amplifier eOP is connected between the fourth resistor R4 and the fifth resistor R5.

In the present invention, as FIG. 4 shows, the first voltage regulating unit 132 is constituted by the second MOSFET Q2, the fourth resistor R4 and the fifth resistor R5. On the other hand, the second voltage regulating unit 133 comprises a third MOSFET Q3, a fourth MOSFET Q4, a sixth resistor R6, and a diode D1, wherein both the third MOSFET Q3 and the fourth MOSFET Q4 are a P-type MOSFET. Moreover, the third MOSFET Q3 is coupled to the input voltage $V_{in}$ by the source terminal thereof, and the gate terminal and the drain terminal of the third MOSFET Q3 are coupled to each other. From FIG. 4, it is found that the fourth MOSFET Q4 is coupled to the drain terminal of the third MOSFET Q3 by the source terminal thereof, and the gate terminal and the drain terminal of the fourth MOSFET Q4 are coupled to each other. In addition, the sixth resistor R6 is coupled to the drain terminal of the fourth MOSFET Q4 by one end thereof, and the diode R1 is connected between the other end of the sixth resistor R6 and the ground terminal GND.

Figure 5:
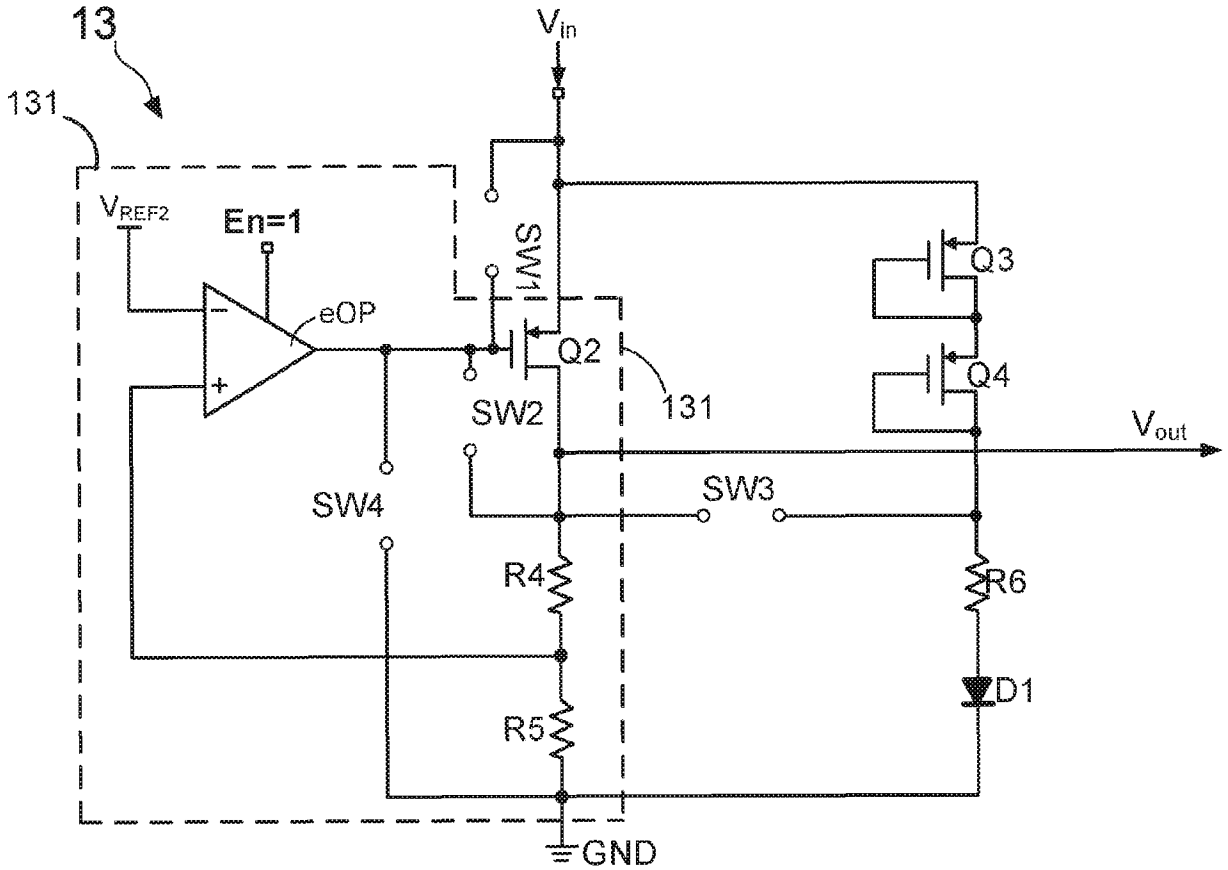
FIG. 5 shows a circuit diagram describing operation mode of the voltage regulating module.

Thus, above descriptions have introduced the circuit constitution of the smart low dropout (LDO) voltage regulator provided by the present invention clearly and completely. Next, working modes including operation mode and sleep mode of this novel LDO voltage regulator will be further introduced and explained in following paragraphs. Please refer to FIG. 5, there is provided a circuit diagram describing the operation mode of the voltage regulating module 13. According to FIG. 3 and FIG. 5, it is able to know that, the input voltage detecting unit 11 is not activated when the enable signal En is set to be a high-level signal (En="1") as well as the detection enabling signal is set to be a low-level signal (En_sel="0"). Meanwhile, all the first switch SW1, the second switch SW2, the third switch SW3, and the fourth switch SW4 are switched to open circuit according to the controlling of the switch controlling signal produced by the switch controlling unit 12, such that the smart LDO voltage regulator 1 provides an voltage $V_{out}$ to the back-end device 3 through the LDO voltage regulating unit 131. In this situation, the smart LDO voltage regulator 1 works at an operation mode.

Figure 6:
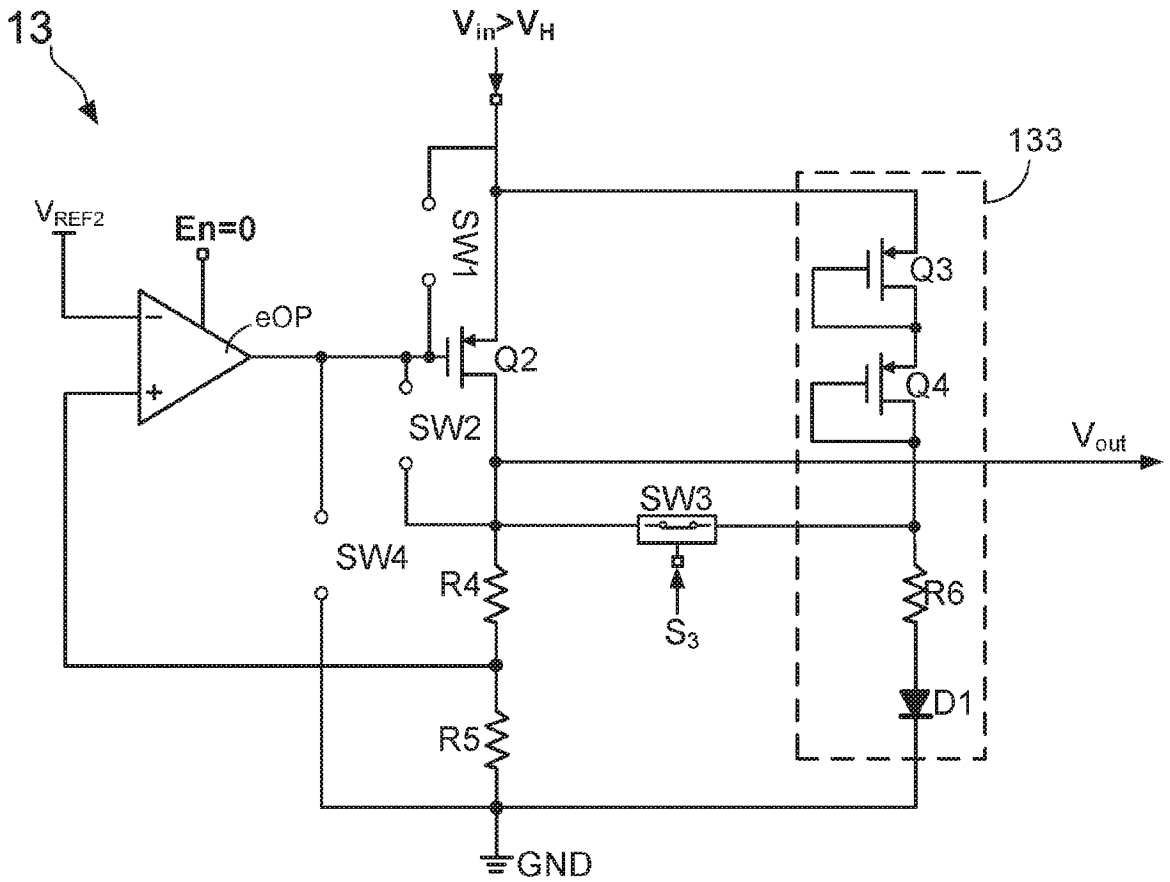
FIG. 6, FIG. 7 and FIG. 8 show circuit diagrams describing sleep mode of the voltage regulating module.

Continuously referring to FIG. 4 and FIG. 6, wherein FIG. 6 shows a circuit diagram describing the sleep mode of the voltage regulating module 13. After comparing FIG. 4 and FIG. 6, electronic engineers can easily find that, the input voltage detecting unit 11 would generate different voltage sensing signal (including first sensing data signal $D_1$ and second sensing data signal $D_1$) according to the variation of the input voltage $V_{in}$ under the enable signal being set to be a low-level signal. In the meantime, the switch controlling unit 12 produces switch controlling signal to change a switch setting of the switch unit 12 for switching the first switch SW1, the second switch SW2, the third switch SW3, and the fourth switch SW4 to short circuit or open circuit, so as to facilitate the smart LDO voltage regulator 1 generate an output voltage $V_{out}$ to the back-end device 3 through the first voltage regulating unit 132 or the second voltage regulating unit 133 of the voltage regulating module 13, or directly output the input voltage $V_{in}$ as the output voltage $V_{out}$. In such situation, the smart LDO voltage regulator 1 works at a sleep mode. Relations between the outputting of the voltage sensing signal and the variation of the input voltage $V_{in}$ are summarized in following Table (1).

TABLE (1)

| | Voltage sensing signal | |
|---|---|---|
| Input voltage $V_{in}$ | First sensing data signal $D_1$ | Second sensing data signal $D_1$ |
| $V_{in} > V_H$ | 0 | 0 |
| $V_H > V_{in} > V_L$ | 1 | 0 |
| $V_{in} < V_L$ | 1 | 1 |

Figure 7:
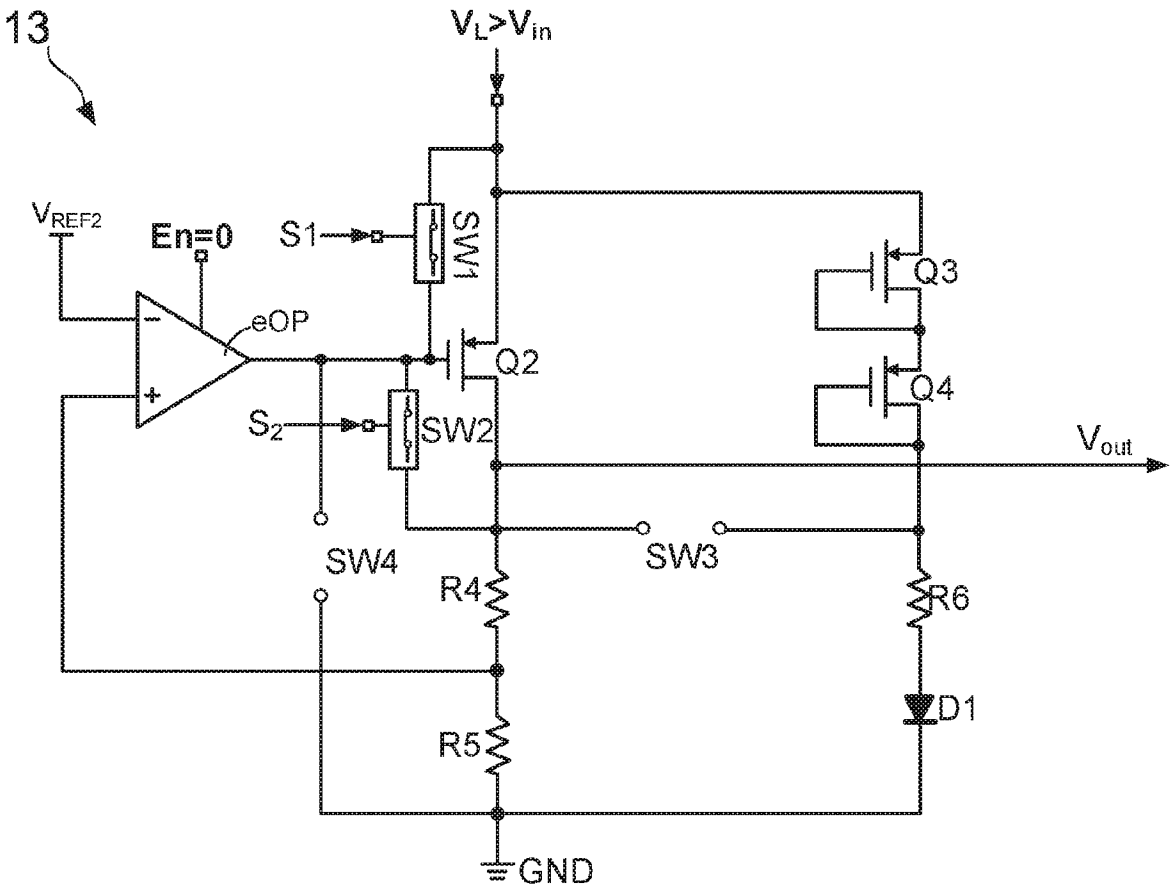

After comparing FIG. 4 with FIG. 6, it is understood that the third switch SW3 is switched to short circuit when the enable signal En is set to be the low-level signal as well as the input voltage $V_{in}$ is higher than $V_L$. Moreover, all the first switch SW1, the second switch SW2 and the fourth switch SW4 are switched to open circuit, such that the voltage regulating module 13 is switched to the sleep mode so as to facilitate the smart LDO voltage regulator 1 produce the output voltage $V_{out}$ through the second voltage regulating unit 133. Continuously referring to FIG. 4 and FIG. 7, wherein FIG. 7 shows a circuit diagram describing the sleep mode of the voltage regulating module 13. After comparing FIG. 4 and FIG. 6, electronic engineers can easily find that, the second switch SW2 is switched to short circuit when the enable signal En is set to be the low-level signal as well as the input voltage $V_{in}$ is higher than $V_L$ and lower than $V_H$. Moreover, all the first switch SW1, the third switch SW3 and the fourth switch SW4 are switched to open circuit, such that the voltage regulating module 13 is switched to the sleep mode so as to facilitate the smart LDO voltage regulator 1 produce the output voltage $V_{out}$ through the first voltage regulating unit 132.

Figure 8:
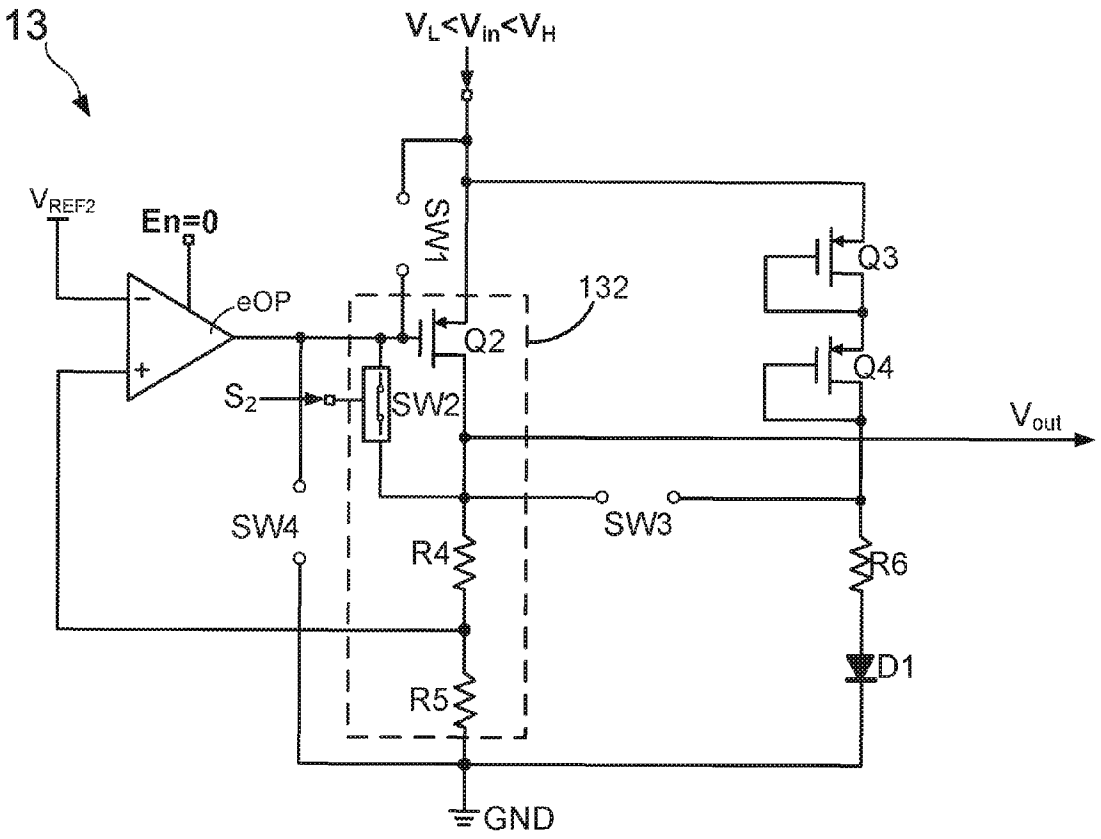

In addition, please refer to FIG. 4 and FIG. 8, wherein FIG. 8 shows a circuit diagram describing the sleep mode of the voltage regulating module 13. After comparing FIG. 4 and FIG. 8, it is able to know that, both the first switch SW1 and the second switch SW2 are switched to short circuit when the enable signal En is set to be the low-level signal as well as the input voltage $V_{in}$ is lower than $V_L$. Moreover, both the third switch SW3 and the fourth switch SW4 are switched to open circuit, such that the voltage regulating module 13 is switched to the sleep mode so as to facilitate the smart LDO voltage regulator 1 directly output the input voltage $V_{in}$ as the output voltage $V_{out}$. Because this smart LDO voltage regulator 1 is mainly applied in portable electronic devices, especially in a smart phone or a tablet PC. Numeric values corresponding to the variation of the input voltage $V_{in}$ are exemplarily listed in following Table (2).

TABLE (2)

| Range of input voltage $V_{in}$ | Voltage sensing signal: First sensing data signal $D_1$ | Voltage sensing signal: Second sensing data signal $D_1$ |
|---|---|---|
| 3.3 V ($V_{DD}$)-2.9 V | 0 | 0 |
| 2.9 V-2.3 V | 1 | 0 |
| <2.3 V | 1 | 1 |

Figure 9A:
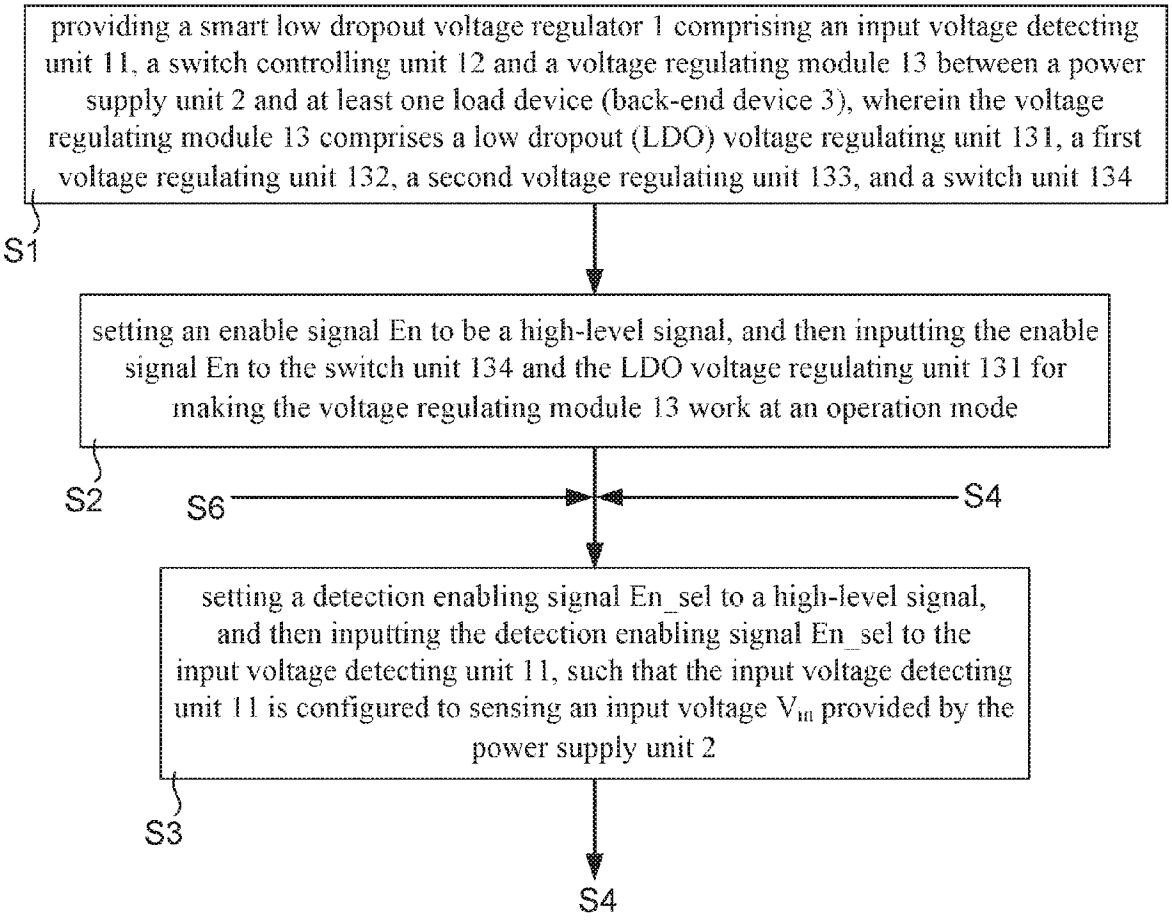
FIG. 9A and FIG. 9B show flow charts of a smart low dropout voltage regulating method according to the present invention.
Figure 9B:
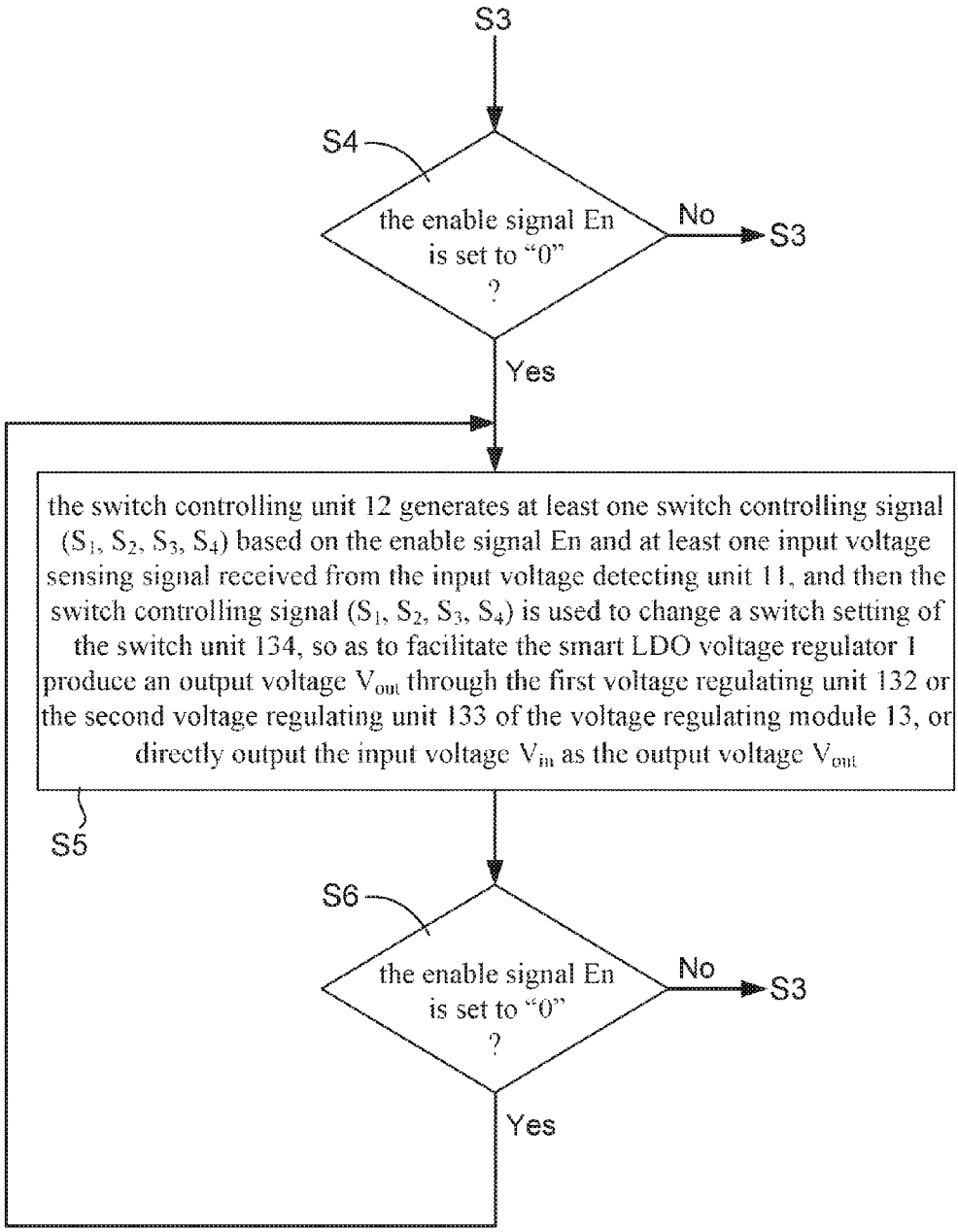

Herein, it needs to further explain that, for facilitating this smart low dropout voltage regulator 1 automatically enter the sleep mode or the operation mod, a circuit controlling algorithm can be adopted for switching the working modes of the smart LDO voltage regulator 1. FIG. 9A and FIG. 9B exhibit flow charts of a smart low dropout voltage regulating method according to the present invention. Moreover, as FIG. 9A and FIG. 9B show, the smart LDO voltage regulating method mainly comprising 6 steps as follows:

Step (S1): providing a smart low dropout voltage regulator 1 comprising an input voltage detecting unit 11, a switch controlling unit 12 and a voltage regulating module 13 between a power supply unit 2 and at least one load device (back-end device 3), wherein the voltage regulating module 13 comprises a low dropout (LDO) voltage regulating unit 131, a first voltage regulating unit 132, a second voltage regulating unit 133, and a switch unit 134;

Step (S2): setting an enable signal En to be a high-level signal, and then inputting the enable signal En to the switch unit 134 and the LDO voltage regulating unit 131 for making the voltage regulating module 13 work at an operation mode;

Step (S3): setting a detection enabling signal En_sel to a high-level signal, and then inputting the detection enabling signal En_sel to the input voltage detecting unit 11, such that the input voltage detecting unit 11 is configured to sensing an input voltage $V_{in}$ provided by the power supply unit 2;

Step (S4): determining whether the enable signal En is set to be a low-level signal or not, if yes, proceeding to step (S5); otherwise, proceeding back to step (S3); Step (S5): the switch controlling unit 12 generates at least one switch controlling signal ($S_1$, $S_2$, $S_3$, $S_4$) based on the enable signal En and at least one input voltage sensing signal received from the input voltage detecting unit 11, and then the switch controlling signal ($S_1$, $S_2$, $S_3$, $S_4$) is used to change a switch setting of the switch unit 134, so as to facilitate the smart LDO voltage regulator 1 produce an output voltage $V_{out}$ through the first voltage regulating unit 132 or the second voltage regulating unit 133 of the voltage regulating module 13, or directly output the input voltage $V_{in}$ as the output voltage $V_{out}$;

Step (S6): determining whether the enable signal En is set to be the low-level signal or not, if yes, proceeding back to step (S5); otherwise, proceeding back to step (S3).

Figure 1:
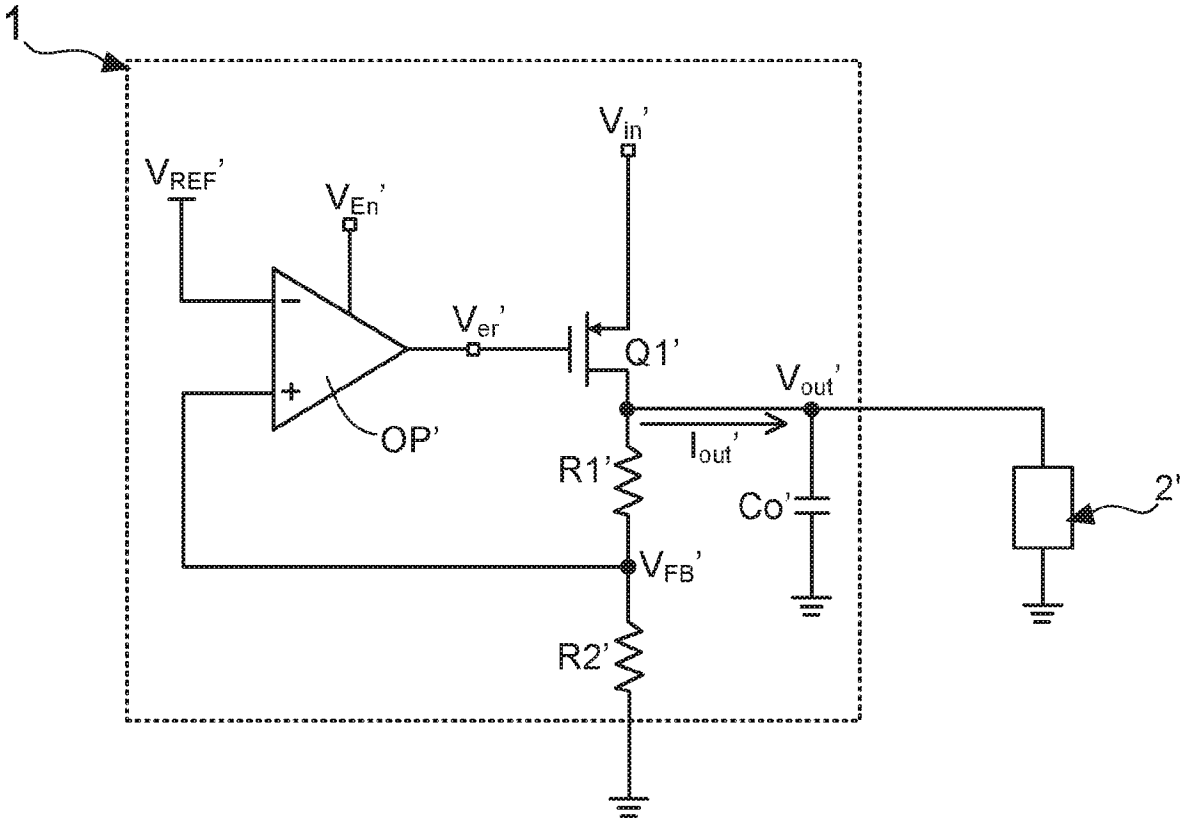
FIG. 1 (Prior Art)
FIG. 1 shows a circuit diagram of a conventional LDO voltage regulator.

Therefore, through above descriptions, the smart low dropout voltage regulator and the smart voltage regulating method proposed by the present invention have been introduced completely and clearly; in summary, the present invention includes the advantages of:

(1) Differing from conventional LDO voltage regulator having the circuit shown in FIG. 1 being unable to work at a sleep mode for saving power dissipation, the present invention discloses a smart low dropout (LDO) voltage regulator 1 capable of being switched to an operation mode or a sleep mode based on the controlling of an enablable signal En. This smart LDO voltage regulator 1 comprises an input voltage detecting unit 11, a switch controlling unit 12 and a voltage regulating module 13. During the sleep mode of the smart LDO voltage regulator 1, the switch controlling unit 12 generates a switch controlling signal ($S_1$, $S_2$, $S_3$, $S_4$) to change a switch setting of a switch unit 134 integrated in the voltage regulating module 13, so as to facilitate the smart LDO voltage regulator 1 produce an output voltage $V_{out}$ through a first voltage regulating unit 132 or a second voltage regulating unit 133 particularly arranged in voltage regulating module 13, or directly output input voltage $V_{in}$ as the output voltage $V_{out}$.

(2) It is worth explaining that, during the sleep mode, all the circuit units stop working except the input voltage detecting unit 11 may be activated by the detection enabling signal En_sel. Therefore, the power dissipation of this smart LDO voltage regulator 1 can be lowered loss to a minimum value.

The above description is made on embodiments of the present invention. However, the embodiments are not intended to limit scope of the present invention, and all equivalent implementations or alterations within the spirit of the present invention still fall within the scope of the present invention.

What is claimed is:

1. A smart low dropout voltage regulator, comprising:

an input voltage detecting unit, being coupled to an external power supply unit, used for sensing an input voltage provided by the power supply unit;

a switch controlling unit, being coupled to the input voltage detecting unit and an enable signal, using for correspondingly produce at least one switch controlling signal based on the enable signal and at least one input voltage sensing signal received from the input voltage detecting unit; and a voltage regulating module, being coupled to the switch controlling unit, the enable signal and the input voltage, and comprising:

a low dropout (LDO) voltage regulating unit, being coupled to the input voltage and the enable signal;

a first voltage regulating unit, being coupled to the input voltage;

a second voltage regulating unit, being coupled to the input voltage; and a switch unit, being connected between the LDO voltage regulating unit, the first voltage regulating unit and the second voltage regulating unit; moreover, the switch unit being also coupled to the switch controlling unit;

wherein the voltage regulating module is switched to an operation mode or a sleep mode by setting the enable signal to be a high-level signal or low-level signal;

wherein during the sleep mode, the switch controlling unit producing the said switch controlling signal to change a switch setting of the switch unit, so as to facilitate the smart low dropout voltage regulator generate an output voltage through the first voltage regulating unit or the second voltage regulating unit of the voltage regulating module.

2. The smart low dropout voltage regulator of claim 1, wherein the switch controlling unit is a combinatorial logic circuit with three input terminals and four output terminals.

3. The smart low dropout voltage regulator of claim 1, wherein the input voltage detecting unit comprises:

a first resistor, being coupled to the input voltage by one end thereof;

a first comparator, being coupled to the other end of the first resistor and a first reference voltage by one negative input end and one positive input end thereof;

a second resistor, being coupled to the other end of the first resistor and the negative input of the first comparator by one end thereof;

a second comparator, being coupled to the other end of the second resistor and the first reference voltage by one negative input end and one positive input end thereof;

a third resistor, being coupled to the other end of the second resistor and the negative input of the second comparator by one end thereof;

a first MOSFET, being coupled to the other end of the third resistor and a detection enabling signal by one drain terminal and one gate terminal thereof; moreover, the first MOSFET being also coupled to a ground terminal by one source terminal thereof;

a first flip-flop with two input ends and one output end, wherein the two input ends of the first flip-flop are coupled to one output end of the first comparator and the detection enabling signal, respectively; and a second flip-flop with two input ends and one output end, wherein the two input ends of the second flip-flop are coupled to one output end of the second comparator and the detection enabling signal, respectively.

4. The smart low dropout voltage regulator of claim 3, wherein the LDO voltage regulating unit comprises:

a second MOSFET, being coupled to the input voltage by one source terminal thereof;

a fourth resistor, being coupled to one drain terminal of the second MOSFET by one end thereof;

a fifth resistor, being coupled to the other end of the fourth resistor by one end thereof; moreover, the other end of the fifth resistor being coupled to the ground terminal; and an error amplifier, being coupled to a second reference voltage and one gate terminal of the second MOSFET by one negative input end and one output end thereof;

moreover, one positive input end of the error amplifier being connected between the fourth resistor and the fifth resistor.

5. The smart low dropout voltage regulator of claim 4, wherein the first voltage regulating unit is constituted by the second MOSFET, the fourth resistor and the fifth resistor.

6. The smart low dropout voltage regulator of claim 4, wherein the second voltage regulating unit comprises:

a third MOSFET, being coupled to the input voltage by one source terminal thereof; moreover, one gate terminal and one drain terminal of the third MOSFET being coupled to each other;

a fourth MOSFET, being coupled to the drain terminal of the third MOSFET by one source terminal thereof; moreover, one gate terminal and one drain terminal of the fourth MOSFET being coupled to each other;

a sixth resistor, being coupled to the drain terminal of the fourth MOSFET by one end thereof; and a diode, being connected between the other end of the sixth resistor and the ground terminal.

7. The smart low dropout voltage regulator of claim 6, wherein the switch unit comprises:

a first switch, being coupled between the source terminal and the gate terminal of the second MOSFET;

a second switch, being coupled between the gate terminal and the drain terminal of the second MOSFET;

a third switch, being coupled between the fourth resistor and the sixth resistor; and a fourth switch, being coupled between the output end of the error amplifier and the ground terminal;

wherein when the enable signal is set to be the high-level signal, all the first switch, the second switch, the third switch, and the forth switch being switched to open circuit, such that the voltage regulating module is switched to the operation mode so as to facilitate the smart low dropout voltage regulator generate the output voltage through the LDO voltage regulating unit.

8. The smart low dropout voltage regulator of claim 6, wherein the first MOSFET is a N-type MOSFET, and each of the second MOSFET, the third MOSFET and the fourth MOSFET are a P-type MOSFET.

9. The smart low dropout voltage regulator of claim 7, wherein the third switch is switched to short circuit when the enable signal is set to be the low-level signal as well as the input voltage is higher than a high-level voltage; moreover, all the first switch, the second switch and the fourth switch being switched to open circuit, such that the voltage regulating module is switched to the sleep mode so as to facilitate the smart low dropout voltage regulator produce the output voltage through the second voltage regulating unit.

10. The smart low dropout voltage regulator of claim 7, wherein the second switch is switched to short circuit when the enable signal is set to be the low-level signal as well as the input voltage is higher than a low-level voltage and lower than a high-level voltage; moreover, all the first switch, the third switch and the fourth switch being switched to open circuit, such that the voltage regulating module is switched to the sleep mode so as to facilitate the smart low dropout voltage regulator produce the output voltage through the first voltage regulating unit.

11. The smart low dropout voltage regulator of claim 7, wherein both the first switch and the second switch are switched to short circuit when the enable signal is set to be the low-level signal as well as the input voltage is lower than a low-level voltage;

moreover, both the third switch and the fourth switch being switched to open circuit, such that the voltage regulating module is switched to the sleep mode so as to facilitate the smart low dropout voltage regulator directly output the input voltage as the output voltage.

12. A smart low dropout voltage regulating method, comprising:

(1) providing a smart low dropout voltage regulator comprising an input voltage detecting unit, a switch controlling unit and a voltage regulating module between a power supply unit and at least one load device, wherein the voltage regulating module comprises a low dropout (LDO) voltage regulating unit, a first voltage regulating unit, a second voltage regulating unit, and a switch unit;

(2) setting an enable signal to be one high-level signal, and then inputting the enable signal to the switch unit and the LDO voltage regulating unit for making the voltage regulating module work at an operation mode;

(3) setting a detection enabling signal to one high-level signal, and then inputting the detection enabling signal to the input voltage detecting unit, such that the input voltage detecting unit is configured to sensing an input voltage provided by the power supply unit;

(4) determining whether the enable signal is set to be one low-level signal or not, if yes, proceeding to step (5); otherwise, proceeding back to step (3);

(5) the switch controlling unit generating at least one switch controlling signal based on the enable signal and at least one input voltage sensing signal received from the input voltage detecting unit, and then the switch controlling signal is used to change a switch setting of the switch unit, so as to facilitate the smart low dropout voltage regulator produce an output voltage through the first voltage regulating unit or the second voltage regulating unit of the voltage regulating module, or directly output the input voltage as the output voltage;

(6) determining whether the enable signal is set to be the low-level signal or not, if yes, proceeding back to step (5); otherwise, proceeding back to step (3).

13. The smart low dropout voltage regulating method of claim 12, wherein the input voltage detecting unit comprises:

a first resistor, being coupled to the input voltage by one end thereof;

a first comparator, being coupled to the other end of the first resistor and a first reference voltage by one negative input end and one positive input end thereof;

a second resistor, being coupled to the other end of the first resistor and the negative input of the first comparator by one end thereof;

a second comparator, being coupled to the other end of the second resistor and the first reference voltage by one negative input end and one positive input end thereof;

a third resistor, being coupled to the other end of the second resistor and the negative input of the second comparator by one end thereof;

a first MOSFET, being coupled to the other end of the third resistor and a detection enabling signal by one drain terminal and one gate terminal thereof; moreover, the first MOSFET being also coupled to a ground terminal by one source terminal thereof;

a first flip-flop with two input ends and one output end, wherein the two input ends of the first flip-flop are coupled to one output end of the first comparator and the detection enabling signal, respectively; and a second flip-flop with two input ends and one output end, wherein the two input ends of the second flip-flop are coupled to one output end of the second comparator and the detection enabling signal, respectively.

14. The smart low dropout voltage regulating method of claim 13, wherein the LDO voltage regulating unit comprises:

a second MOSFET, being coupled to the input voltage by one source terminal thereof;

a fourth resistor, being coupled to one drain terminal of the second MOSFET by one end thereof;

a fifth resistor, being coupled to the other end of the fourth resistor by one end thereof; moreover, the other end of the fifth resistor being coupled to the ground terminal; and an error amplifier, being coupled to a second reference voltage and one gate terminal of the second MOSFET by one negative input end and one output end thereof;

moreover, one positive input end of the error amplifier being also connected between the fourth resistor and the fifth resistor.

15. The smart low dropout voltage regulating method of claim 14, wherein the switch controlling unit is a combinatorial logic circuit with three input terminals and four output terminals; moreover, the first voltage regulating unit being constituted by the second MOSFET, the fourth resistor and the fifth resistor.

16. The smart low dropout voltage regulating method of claim 14, wherein the second voltage regulating unit comprises:

a third MOSFET, being coupled to the input voltage by one source terminal thereof;

moreover, one gate terminal and one drain terminal of the third MOSFET being coupled to each other;

a fourth MOSFET, being coupled to the drain terminal of the third MOSFET by one source terminal thereof; moreover, one gate terminal and one drain terminal of the fourth MOSFET being coupled to each other;

a sixth resistor, being coupled to the drain terminal of the fourth MOSFET by one end thereof; and a diode, being coupled between the other end of the sixth resistor and the ground terminal.

17. The smart low dropout voltage regulating method of claim 16, wherein the switch unit comprises:

a first switch, being coupled between the source terminal and the gate terminal of the second MOSFET;

a second switch, being coupled between the gate terminal and the drain terminal of the second MOSFET;

a third switch, being coupled between the fourth resistor and the sixth resistor; and a fourth switch, being coupled between the output end of the error amplifier and the ground terminal;

wherein when the enable signal is set to be the high-level signal, all the first switch, the second switch, the third switch, and the forth switch being switched to open circuit, such that the voltage regulating module is switched to the operation mode so as to facilitate the smart low dropout voltage regulator generate the output voltage through the LDO voltage regulating unit.

18. The smart low dropout voltage regulating method of claim 17, wherein the third switch is switched to short circuit when the enable signal is set to be the low-level signal as well as the input voltage is higher than a high-level voltage; moreover, all the first switch, the second switch and the fourth switch being switched to open circuit, such that the voltage regulating module is switched to the sleep mode so as to facilitate the smart low dropout voltage regulator produce the output voltage through the second voltage regulating unit.

19. The smart low dropout voltage regulating method of claim 17, wherein the second switch is switched to short circuit when the enable signal is set to be the low-level signal as well as the input voltage is higher than a low-level voltage and lower than a high-level voltage; moreover, all the first switch, the third switch and the fourth switch being switched to open circuit, such that the voltage regulating module is switched to the sleep mode so as to facilitate the smart low dropout voltage regulator produce the output voltage through the first voltage regulating unit.

20. The smart low dropout voltage regulating method of claim 17, wherein both the first switch and the second switch are switched to short circuit when the enable signal is set to be the low-level signal as well as the input voltage is lower than a low-level voltage; moreover, both the third switch and the fourth switch being switched to open circuit, such that the voltage regulating module is switched to the sleep mode so as to facilitate the smart low dropout voltage regulator directly output the input voltage as the output voltage.

* * * * *